US006491091B1

(12) United States Patent
Lin et al.

(10) Patent No.: US 6,491,091 B1
(45) Date of Patent: Dec. 10, 2002

(54) RADIATING FIN ASSEMBLY FOR THERMAL ENERGY ENGINE

(75) Inventors: Pao Lung Lin, No. 69, Lane 99, Chin Shan Rd., Shih Lin Dist., Taipei (TW); Chun-Hsiung Han, 2F, No. 181, Tsu Li Rd., Chungho City, Taipei Hsien (TW)

(73) Assignees: Polo Technology Corp., Taipei Hsien (TW); Pao Lung Lin, Taipei (TW); Chun-Hsiung Han, Taipei Hsien (TW)

( * ) Notice: Subject to any disclaimer, the term of this patent is extended or adjusted under 35 U.S.C. 154(b) by 0 days.

(21) Appl. No.: 09/987,503

(22) Filed: Nov. 15, 2001

(51) Int. Cl.[7] ..... F28F 7/00
(52) U.S. Cl. ..... 165/80.3; 165/182; 60/650
(58) Field of Search ..... 165/182, 185, 165/80.3

(56) References Cited

U.S. PATENT DOCUMENTS 1,896,501 A * 2/1933 Whitaker ..... 164/105
2,289,984 A * 7/1942 Mouromtseff et al. ..... 165/180
2,400,157 A * 5/1946 Merry ..... 123/41.69
3,372,733 A * 3/1968 Callender ..... 165/185

* cited by examiner

*Primary Examiner*—Allen Flanigan
(74) *Attorney, Agent, or Firm*—Rosenberg, Klein & Lee

(57) ABSTRACT

A radiating fin assembly for thermal energy engine comprises a plurality of spacer members each having a plurality of insertion holes, a plurality of radiating plates each sandwiched between two adjacent spacer members and each having a plurality of insertion holes, and a plurality of insertion pins passing through corresponding insertion holes of the spacer members and corresponding insertion holes of the radiating plates to assemble the spacer members with the radiating plates. The spacer members and the radiating plates further have central circular apertures and the radiating fin assembly reduces a temperature of a hot body when the hot body is arranged within the central circular apertures.

1 Claim, 5 Drawing Sheets

RADIATING FIN ASSEMBLY FOR THERMAL ENERGY ENGINE

FIELD OF THE INVENTION

The present invention relates to a radiating fin assembly for thermal energy engine, especially to a radiating fin assembly for thermal energy engine with alternatively arranged spacer members and each radiating plates.

BACKGROUND OF THE INVENTION

The thermal energy engine generally utilizes pressure difference caused by temperature variation to move piston, wherein the temperature variation is achieved by a hot side and a cold side. The hot side is realized by a thermal source to heat the air in a cylinder to have expanded volume. The cold side is realized by a condenser to cool the air in the cylinder to have shrunk volume. In other word, the air in the cylinder of the thermal energy engine is periodically heated and cooled to have expanded and shrunk volume, thus providing a dynamic power.

However, the condenser in above-mentioned thermal energy engine generally has expensive price and the condenser requires regular maintenance.

SUMMARY OF THE INVENTION

It is an object of the present invention to provide a radiating fin assembly for thermal energy engine with low cost and simple structure.

It is another object of the present invention to provide a radiating fin assembly for thermal energy engine with easy assembling.

It is another object of the present invention to provide a radiating fin assembly for thermal energy engine with better temperature reduction ability.

To achieve above object, the present invention provides a radiating fin assembly for thermal energy engine comprising a plurality of spacer members, a plurality of radiating plates and a plurality of insertion pins. Each of the spacer members has a central circular aperture and a plurality of insertion holes. Each of the radiating plates has a central circular aperture and a plurality of insertion holes. Each of the radiating plates is sandwiched between two adjacent spacer members and the insertion holes thereof having the same number as that of the insertion holes of each spacer member. The central circular aperture of each spacer member has the same diameter as that of the circular aperture of each radiating plate. Each radiating plate has a greater area than that of each spacer member. The insertion pins pass through corresponding insertion holes of the spacer members and corresponding insertion holes of the radiating plates to assemble the spacer members with the radiating plates.

The various objects and advantages of the present invention will be more readily understood from the following detailed description when read in conjunction with the appended drawing, in which:

DETAILED DESCRIPTION OF THE INVENTION

Figure 1:
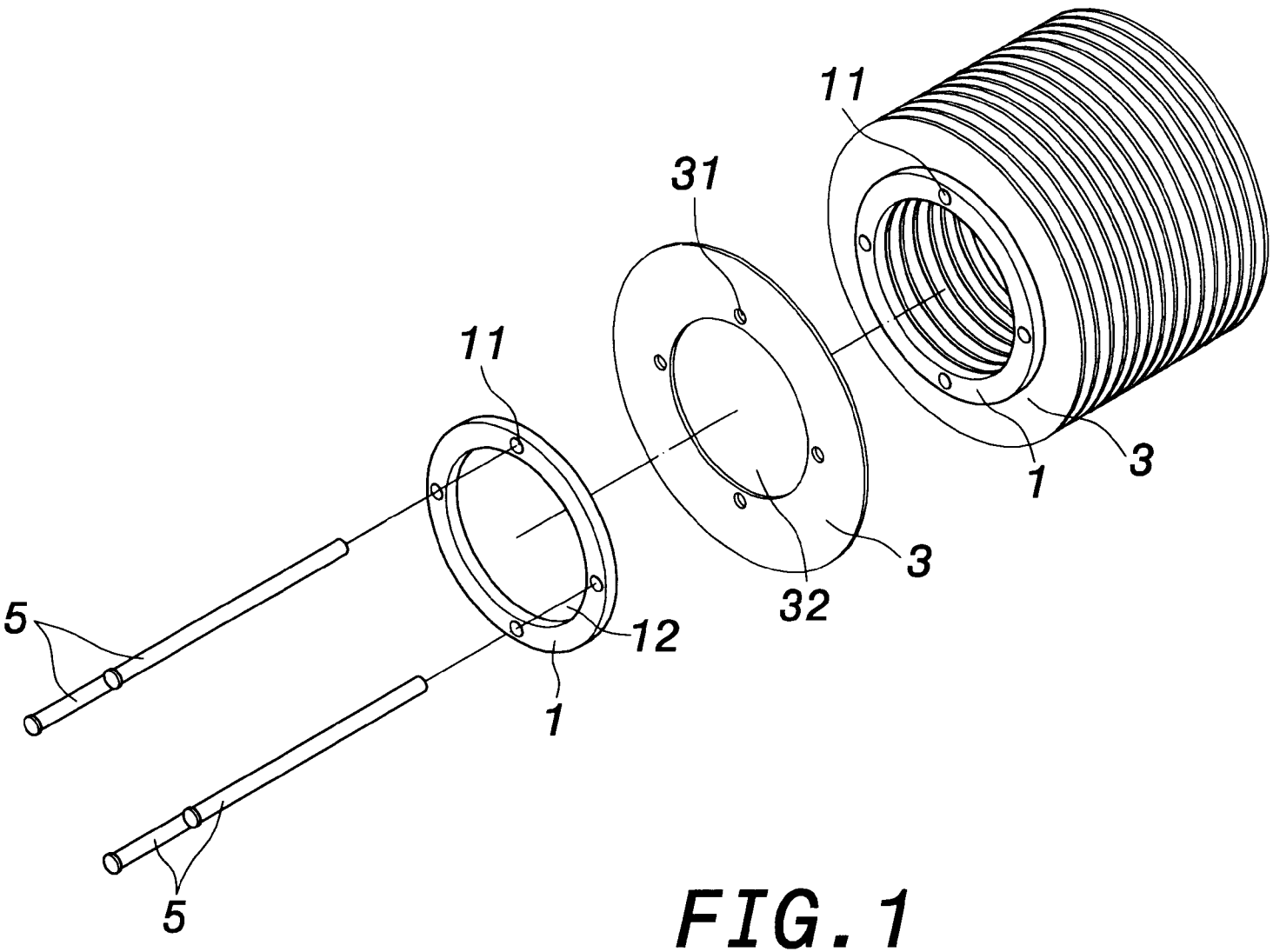
FIG. 1 shows an exploded view of the present invention.
Figure 2:
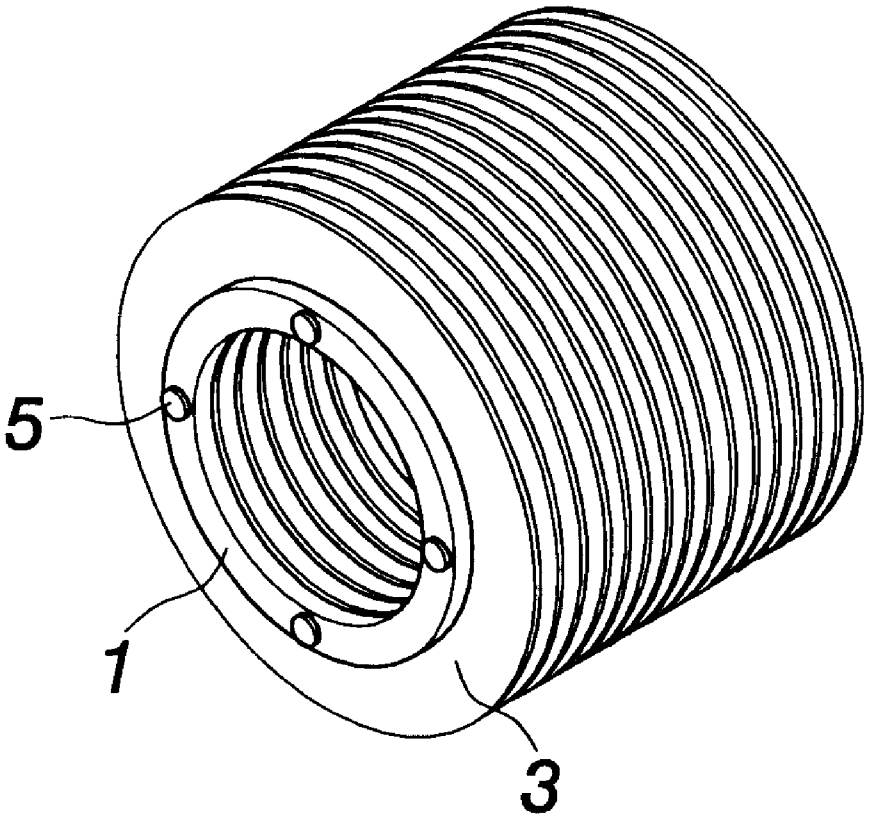
FIG. 2 shows a perspective view of the present invention.

FIGS. 1 and 2 show an exploded view and a perspective of the present invention. The present invention provides a radiating fin assembly for thermal energy engine, which comprises a plurality of spacer members 1, a plurality of radiating plates 3 and a plurality of insertion pins 5.

Each of the spacer members 1 has annulus shape with a central circular aperture 12 and a plurality of insertion holes 11 around the central circular aperture 12. Each of the radiating plates 3 has annulus shape and is sandwiched between two adjacent spacer members 1. The radiating plate 3 has a central circular aperture 32 and a plurality of insertion holes 31 around the central circular aperture 32. The insertion holes 11 of the spacer members 1 have the same number as that of the insertion holes 31 of the radiating plate 3. Moreover, the central circular aperture 12 of each spacer member 1 has the same diameter as that of the circular aperture 32 of each radiating plate 3. The plurality of insertion pins 5 pass through corresponding insertion holes 11 of the spacer members 1 and corresponding insertion holes 31 of the radiating plates 3 to assemble the spacer members 1 with the radiating plates 3.

Figure 3:
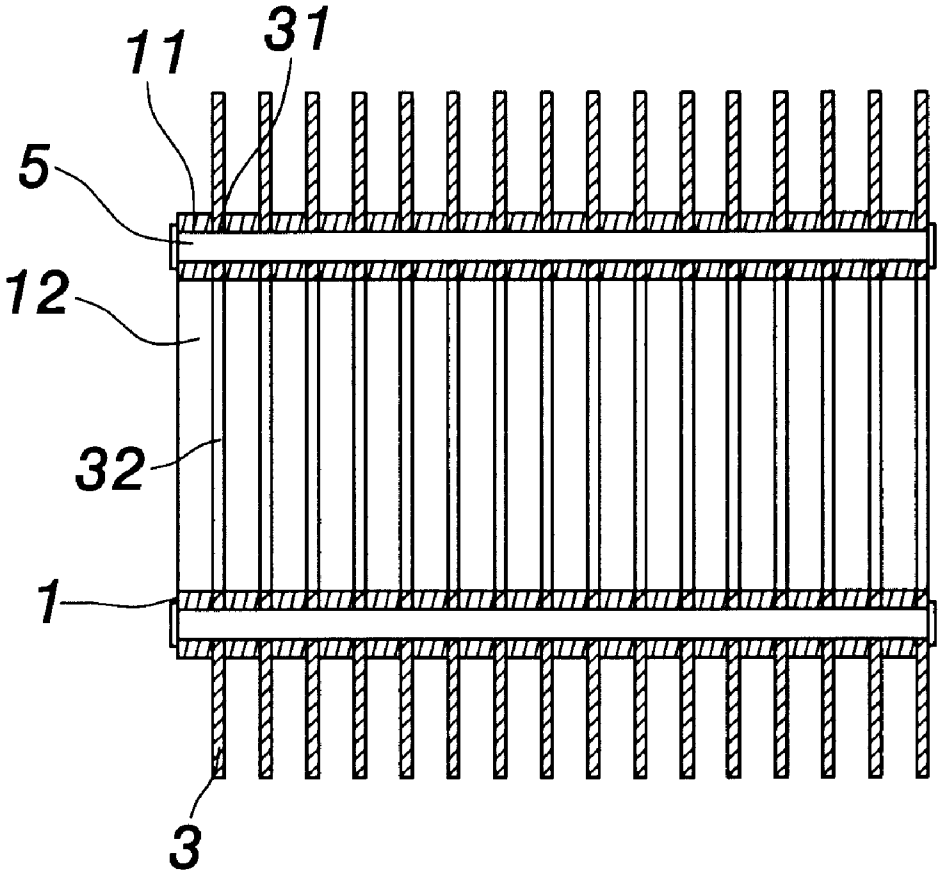
FIG. 3 shows a sectional view of the present invention.

FIG. 3 shows a sectional view of the present invention. As shown in this figure, the insertion pins 5 pass through corresponding insertion holes 11 of the spacer members 1 and corresponding insertion holes 31 of the radiating plates 3 such that the spacer members 1 is firmly assembled with the radiating plates 3. Moreover, each spacer member 1 has a greater thickness than that of each radiating plate 3 to provide smooth air ventilation. Each radiating plate 3 has a greater area than that of each spacer member 1 to increase thermal radiation area. Therefore, the radiating fin assembly for thermal energy engine can provide excellent thermal dissipation effect.

Figure 4:
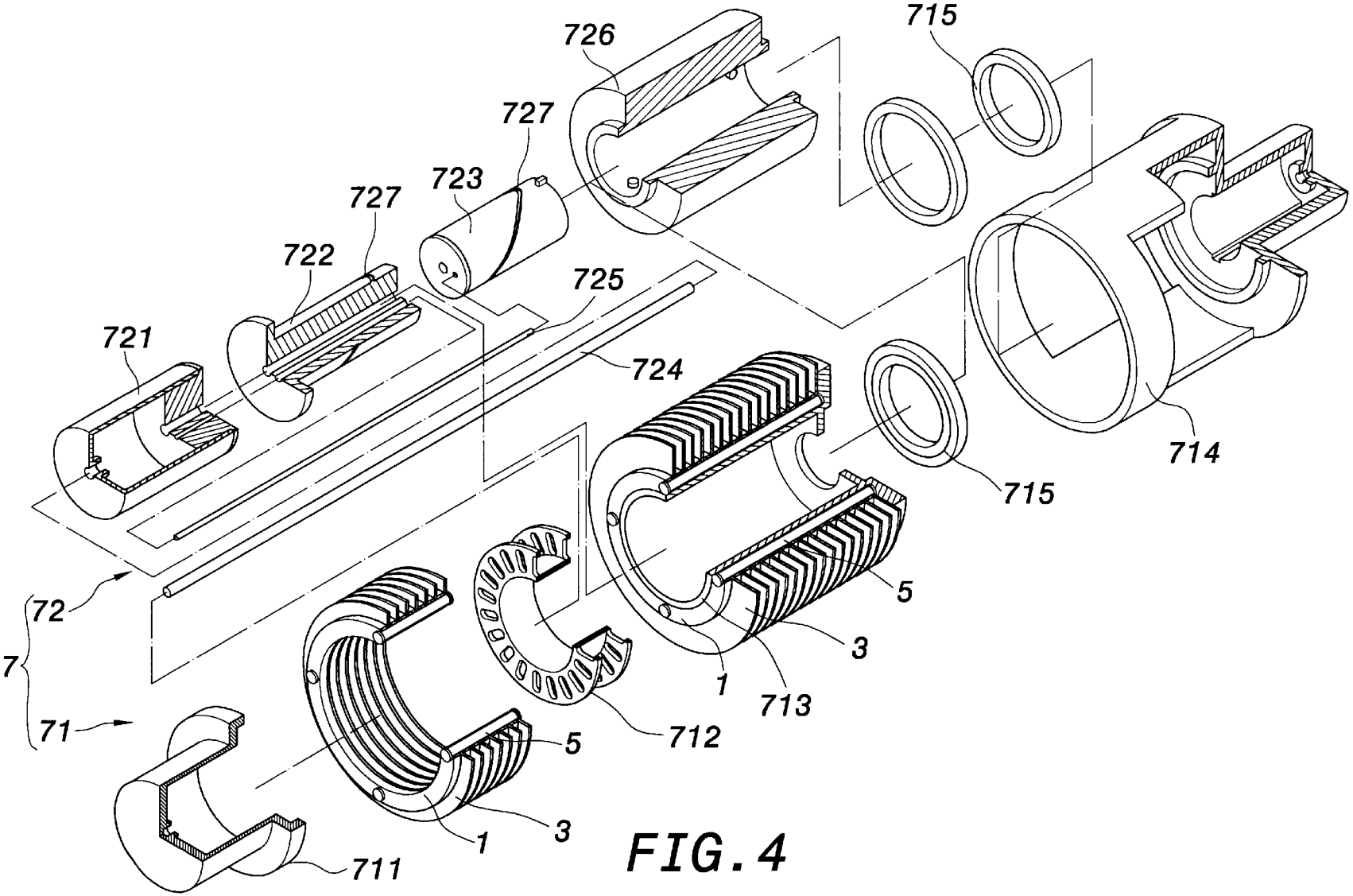
FIG. 4 is an exploded view showing the radiating fin assembly of the present invention being assembled to a thermal energy engine.
Figure 5:
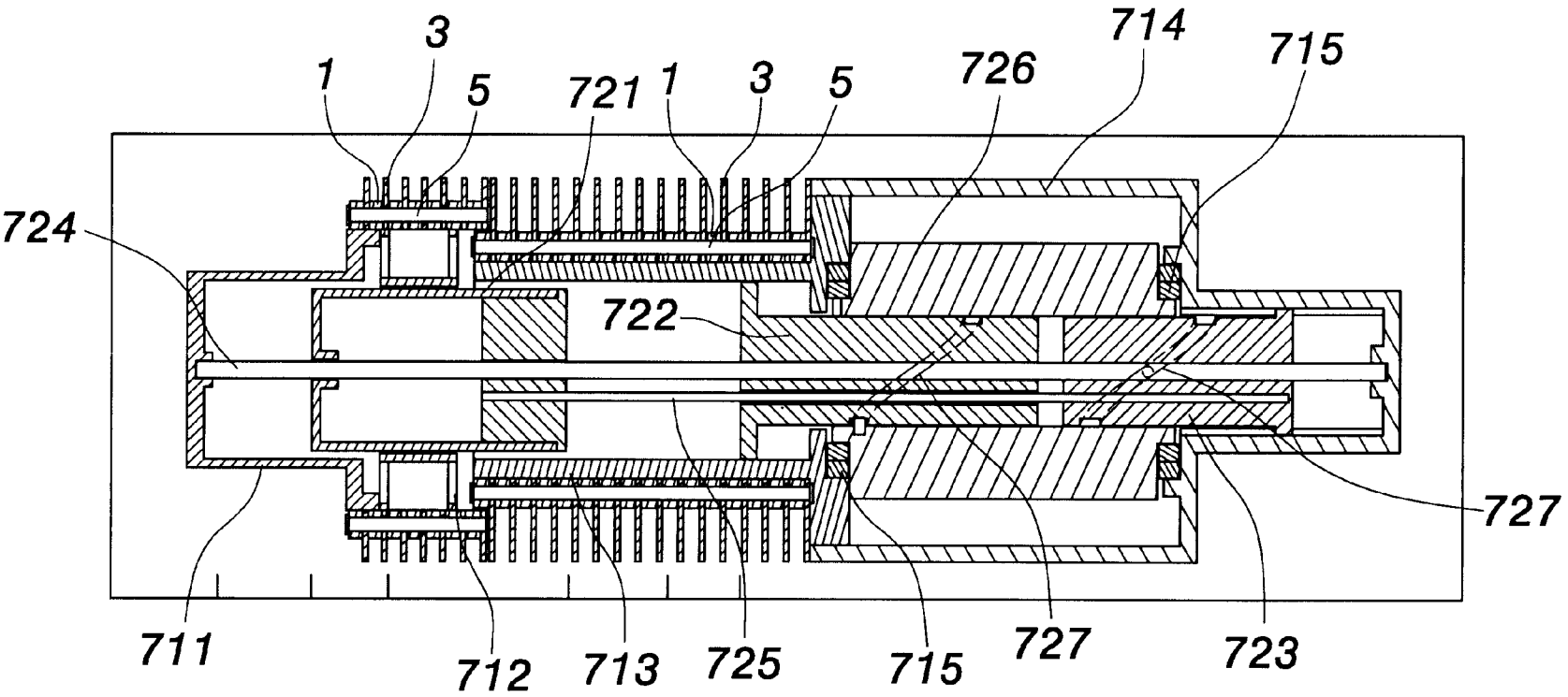
FIG. 5 is a perspective view showing the radiating fin assembly of the present invention being assembled to a thermal energy engine.

FIGS. 4 and 5 are exploded view and perspective view showing the radiating fin assembly of the present invention being assembled to a thermal energy engine 7. The thermal energy engine 7 comprises a cylinder 71 and a piston set 72 arranged in the cylinder 71. The cylinder 71 comprises a front barrel 711, a reheater 712, a middle barrel 713, a rear barrel 714 and a plurality of rings 715. The piston set 72 comprises a first valving piston 721, a power piston 722, a second valving piston 723, a spindle 724, a countershaft 725 and a flywheel 726. The radiating fin assembly of the present invention is arranged outside the cylinder 71 for providing heat radiation function.

An external thermal source (not shown) is provided outside the front barrel 711 to drive the first valving piston 721, the power piston 722, and the second valving piston 723 to have reciprocating movement along the spindle 724. The power piston 722 and the second valving piston 723 have spiral grooves 727 on the outer surface thereof and the flywheel 726 is moved along the spiral grooves 727, thus having rotatory motion. More particularly, the air in the cylinder 71 has variable volume caused by temperature variation. The external thermal source is used to heat the air in the cylinder such that the piston set 72 is moved backward. The radiating fin assembly of the present invention is used to cool the air in the cylinder such that the piston set 72 is moved forward. The radiating fin assembly of the present invention can provide better thermal radiation effect to the thermal energy engine 7, whereby the thermal energy engine 7 has enhanced efficiency.

To sum up, the radiating fin assembly of the present invention has following features:

(1) The radiating fin assembly has alternatively arranged spacer members and radiating plates to provide better thermal radiation effect.

(2) The alternatively arranged spacer members and radiating plates are firmly assembled by insertion pins.

(3) The radiating plate has a greater area than that of each spacer member to increase thermal radiation area.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A heat dissipating structure for a thermal source comprising:

a plurality of thermally conductive rings, each of said thermally conductive rings having a substantially annular shape and having a plurality of first connection passages formed therethrough, each of said thermally conductive rings having a first thickness and a first diameter;

a plurality of spacer rings, each of said spacer rings having a substantially annular shape and having a plurality of second connection passages formed therethrough, each of said spacer rings having a second thickness and a second diameter, each of said spacer rings being sandwiched between a respective pair of adjacent thermally conductive rings, said second diameter being less than said first diameter, said second thickness being greater than said first thickness, each of said plurality of spacer rings forming a ventilating channel between said respective adjacent thermally conductive rings; and, a plurality of connecting pins being received within said first and second connection passages, said plurality of connecting pins securing said thermally conductive rings to said spacer rings, said plurality of connecting pins allowing for selective removal and addition of said thermally conductive rings and said spacer rings to form a user selectable and adjustable heat dissipating surface area, said thermally conductive rings and said spacer rings being mounted on a thermal energy source for dissipating thermal energy.

* * * * *